US006578553B1

(12) United States Patent
Schubert et al.

(10) Patent No.: US 6,578,553 B1
(45) Date of Patent: Jun. 17, 2003

(54) COMMON-RAIL SYSTEM COMPRISING A CONTROLLED HIGH-PRESSURE PUMP AS A SECOND PRESSURE REGULATOR

(75) Inventors: Peter Schubert, Leingarten (DE); Andreas Kellner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/719,253

(22) PCT Filed: Feb. 11, 2000

(86) PCT No.: PCT/DE00/00410

§ 371 (c)(1),
(2), (4) Date: Mar. 14, 2001

(87) PCT Pub. No.: WO00/61933

PCT Pub. Date: Oct. 19, 2000

(30) Foreign Application Priority Data

Sep. 4, 1999 (DE) ..... 199 16 100

(51) Int. Cl.[7] ..... F02M 37/04
(52) U.S. Cl. ..... 123/458; 123/457
(58) Field of Search ..... 123/457, 458, 123/456, 514, 506

(56) References Cited

U.S. PATENT DOCUMENTS 5,035,223 A * 7/1991 Watanabe ..... 123/459
5,313,924 A * 5/1994 Regueiro ..... 123/458
5,558,063 A * 9/1996 Minagawa et al. ..... 123/457
5,878,718 A 3/1999 Rembold et al.
5,918,578 A 7/1999 Oda
6,024,064 A 2/2000 Kato et al.

FOREIGN PATENT DOCUMENTS

| | | |
|---|---|---|
| DE | 195 48 278 | 6/1997 |
| EP | 0 643 219 | 3/1995 |
| JP | 10 054 318 | 2/1998 |
| WO | 97 32122 | 9/1977 |

* cited by examiner

*Primary Examiner*—Thomas N. Moulis
(74) *Attorney, Agent, or Firm*—Kenyon & Kenyon

(57) ABSTRACT

A method and a device are described for controlling an internal combustion engine, particularly an internal combustion engine that has a common-rail system. At least one pump delivers fuel into an accumulator. A pressure in the accumulator is detected. A distinction is made between at least one first operating state and at least one second operating state based on at least one speed signal and/or one load signal. At least one first pressure-control device is used to adjust the pressure in the at least one first operating state. At least one second pressure-control device is used to control the pressure in the at least one second operating state.

9 Claims, 4 Drawing Sheets

COMMON-RAIL SYSTEM COMPRISING A CONTROLLED HIGH-PRESSURE PUMP AS A SECOND PRESSURE REGULATOR

FIELD OF THE INVENTION

The present invention relates to a method and a device for controlling an internal combustion engine.

BACKGROUND INFORMATION

A method and a device for controlling an internal combustion engine are described in German Patent No. 195 48 278. There, a method and a device are described for controlling an internal combustion engine, particularly an internal combustion engine that has a common-rail system. At least one pump delivers fuel into an accumulator and the pressure in the accumulator is detected and controlled to predefined setpoint values by a controller. A valve, which connects the accumulator to the fuel tank, is used as pressure-control means; in addition, a controlled high-pressure pump is used as second pressure-control means.

There are also conventional systems in which only one valve is used for regulating the pressure. The disadvantage of this procedure is that very high power losses occur, since the pump is designed so that it always delivers the maximum required fuel quantity, and the excess fuel quantity is discharged via the pressure-control valve. Very high fuel temperatures can occur because of this power loss. The advantage of this procedure is that the actual pressure is adjusted very quickly and precisely.

Systems equipped with only one controllable high-pressure pump for regulating pressure have the disadvantage that very high demands must be made on the quality of the high-pressure pump.

The change-over to low pressure setpoint values is particularly problematic here. Thus, for example, increased noise emissions can occur during the change-over into overrun, since the low pressure in the accumulator necessary for idling or overrun is first reached after a relatively long delay time has elapsed. The advantage of this procedure is the high efficiency and the low fuel temperature associated with it.

SUMMARY

An object of the present invention is to improve the pressure regulation when working with a method and a device for controlling an internal combustion engine. In particular, the object is to increase efficiency and improve the quality of the pressure regulation.

Using the method according to the present invention makes it possible to achieve the advantages of both strategies for regulating pressure without having to accept their disadvantages. This is achieved in that a distinction is made between at least one first and one second operating state based on at least the speed and/or a load signal. In the first operating state, at least one first pressure-control means is used for adjusting the pressure. In the second operating state, at least one second pressure-control means is used for adjusting the pressure. It is recognized in the present invention that at least the speed and/or the load of the internal combustion engine define various states in which different pressure-control means are advantageous. Further performance characteristics and signals can be used for defining the operating states, it is also advantageous if additional operating states are defined.

It is advantageous if the second operating state prevails at great loads and/or at great speeds, and the first operating state prevails at small loads and/or at low speeds.

It is advantageous that the first pressure-control means is a valve, which connects the accumulator to a low-pressure region, and the second pressure-control means is a controlled pump, which delivers the fuel into the accumulator.

Because in response to a fault in one pressure-control means, the other pressure-control means takes over the control, the availability of the internal combustion engine can be increased in the event of a defect.

DETAILED DESCRIPTION

Figure 1:
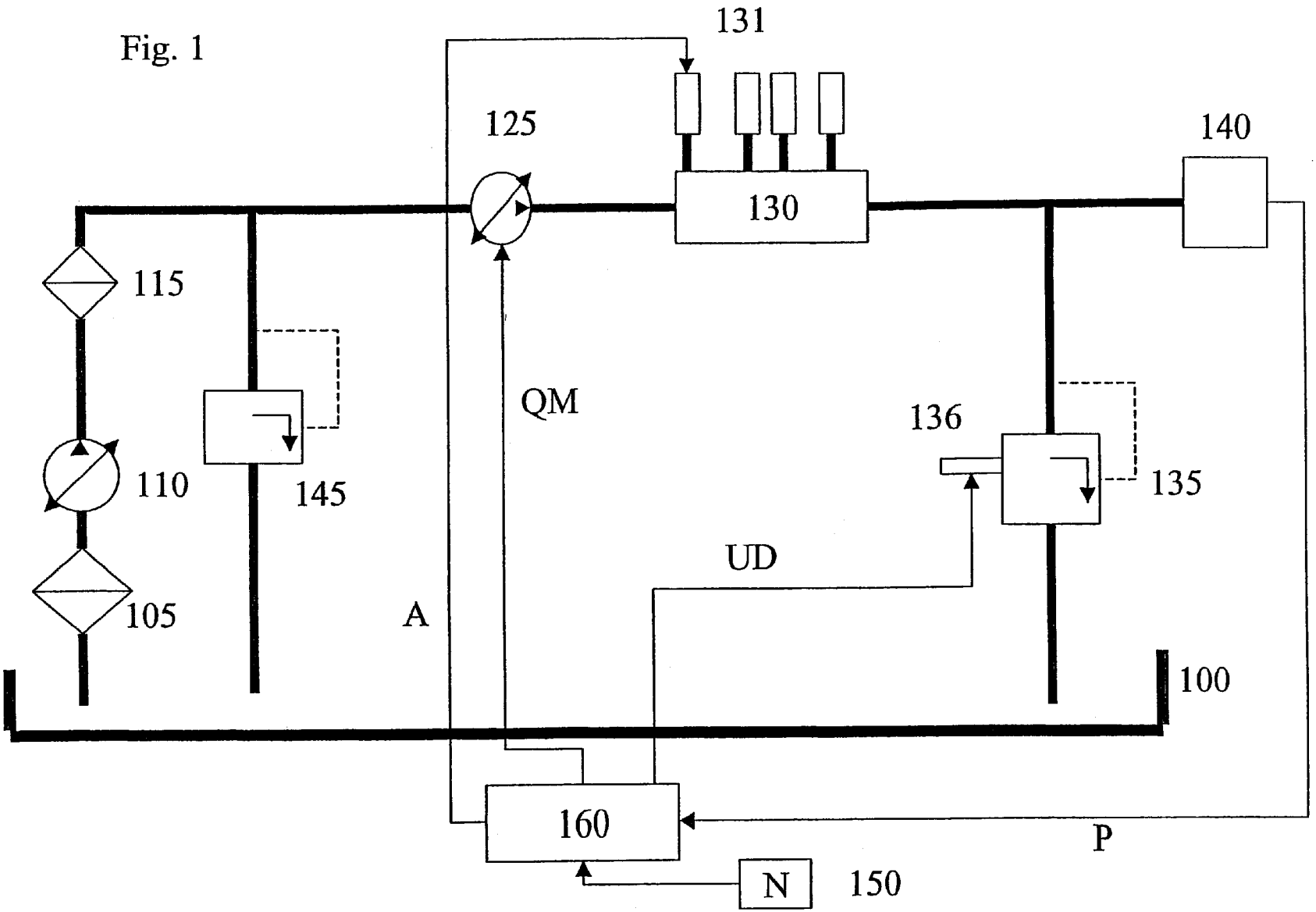
FIG. 1 shows a block diagram of a device according to the present invention.

FIG. 1 shows the components—necessary for understanding the invention—of a fuel-supply system of an internal combustion engine having high-pressure fuel injection. The system depicted is usually called a common-rail system.

A fuel reservoir (tank) is designated by 100. It is connected via a first filter 105 and a presupply pump 110 to a second filtering means 115. From second filtering means 115, the fuel arrives via a line at a high-pressure pump 125. The connecting line between filtering means 115 and high-pressure pump 125 can be connected to reservoir 100 via a low-pressure limiting valve 145.

High-pressure pump 125 is in communication with a rail 130. Rail 130 is also an accumulator and is in contact with various injectors 131 via fuel lines. Rail 130 is connectable to fuel reservoir 100 via a pressure-control valve 135. Pressure-control valve 135 is controllable by a coil 136. Pressure-control valve 135 is designed so that, upon receiving a specific drive signal, it maintains a specific pressure in rail 130 by discharging fuel that is delivered but not needed into reservoir 100.

The lines between the output of high-pressure pump 125 and the input of pressure-control valve 135 are designated as the high-pressure region. In this region, the fuel is under high pressure. The pressure in the high-pressure region is detected by a sensor 140. The lines between tank 100 and high-pressure pump 125 are a low-pressure region.

A control unit 160 acts upon the various actuators, for example, sending a signal QM to high-pressure pump 125, a signal A to injectors 131 and/or a signal UD to pressure-control valve 135. Control unit 160 processes various signals from different sensors 150 that characterize the operating state of the internal combustion engine and/or of the motor vehicle which the internal combustion engine is propelling. Such an operating state is, for example, speed N of the internal combustion engine.

This device functions as follows: The fuel, located in the reservoir, is delivered by presupply pump 110 through filtering means 105 and 115.

If the pressure in the low-pressure region rises to unacceptably high values, then low-pressure limiting valve 145 opens and releases the connection between the output of presupply pump 110 and reservoir 100.

High-pressure pump 125 delivers the fuel from the low-pressure region into the high-pressure region. High-pressure pump 125 builds up a very high pressure in rail 130. Usually pressure values of approximately 30 to 100 bar for example, are attained in systems for internal combustion engines that have externally supplied ignition, and pressure values of approximately 1000 to 2000 bar for example, are attained for self-ignition internal combustion engines. The fuel can be metered under high pressure to the individual cylinders of the internal combustion engine via injectors 131.

Sensor 140 detects pressure P in the rail or in the entire high-pressure region. The pressure in the high-pressure region is regulated by controllable high-pressure pump 125 and the pressure-control valve 135.

An advantageous embodiment results if the pressure-control valve opens upon reaching a specific pressure, which is a function of the drive voltage acting upon the coil of pressure-control valve 136.

Electric fuel pumps, mechanical gear pump, or semirotary pumps, for example, may be used as presupply pump 110.

Figure 2:
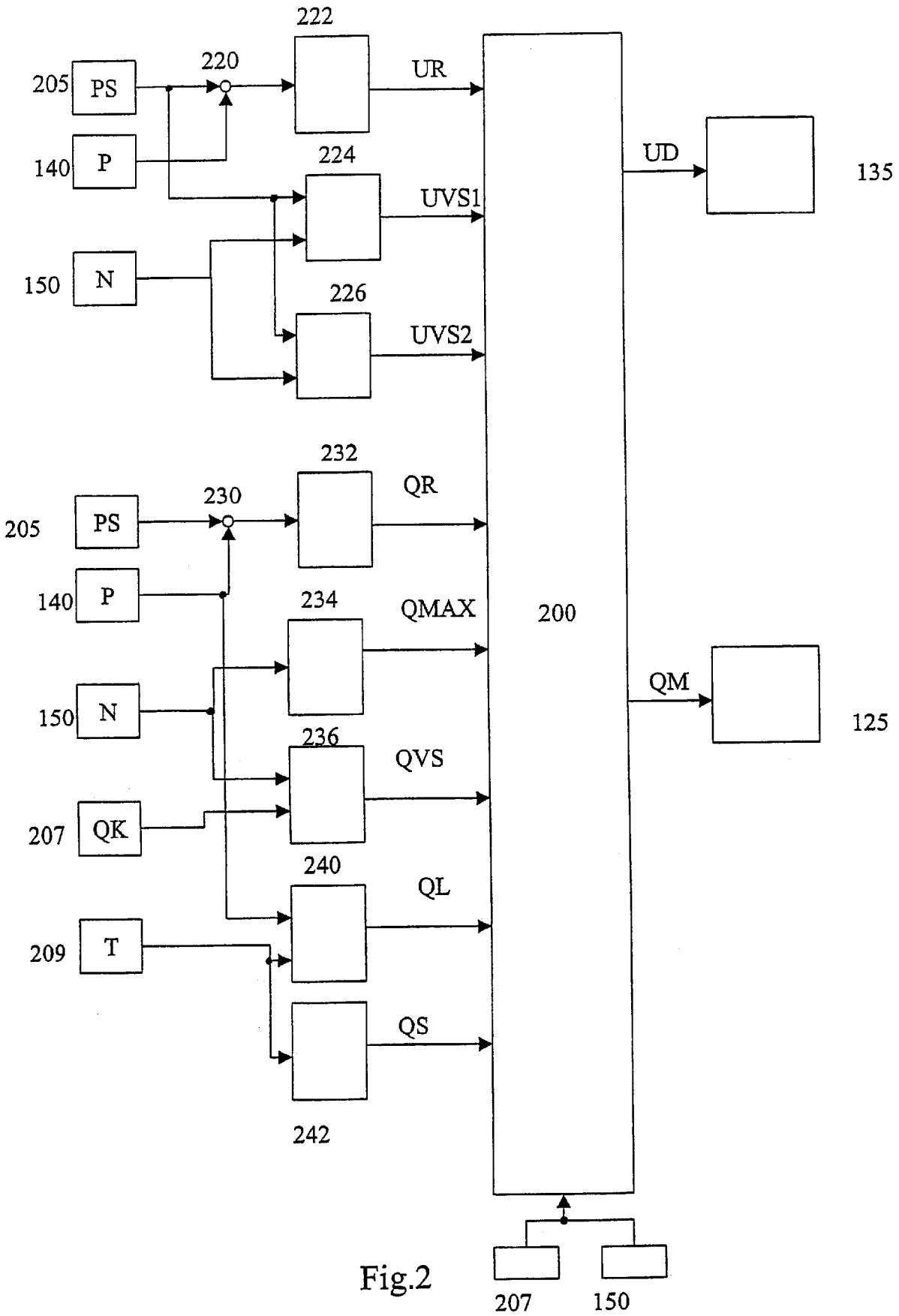
FIG. 2 shows a block diagram of a pressure regulator according to the present invention.

FIG. 2 shows in detail a pressure regulator which is essentially contained in control unit 160. Elements already described in FIG. 1 are designated by corresponding reference numerals.

To present the drawing more clearly, various elements are specified several times, elements having the same reference numerals being one and the same elements. This holds true in particular for the different sensors.

A setpoint input unit 205 supplies a setpoint value PS for the pressure value in accumulator 130 to a connect node 220. Output signal P from pressure sensor 140 is applied to the second input of connect node 220. Connect node 220 sends a signal to a first controller 222. The first controller supplies a signal UR to a selection unit 200.

In addition, the output signal of setpoint input 205 reaches a first precontrol unit 224 and a second precontrol unit 226. Both the first and the second precontrol unit receive output signal N from speed sensor 150. First precontrol unit 224 supplies a signal UVS1 and second precontrol unit 226 supplies a signal UVS2 to selection unit 200.

Setpoint input unit 205 sends setpoint value PS to a second connect node 230, at whose second input actual value P from sensor 140 is applied. Second connect node 230 acts upon second controller 232 with an input signal. Second controller 232 supplies a signal QR to selection unit 200.

A maximum-value input unit 234 receives output signal N from speed sensor 150 and supplies a value QMAX to selection unit 200. In addition, a fuel-delivery control unit 236 supplies a signal QVS to selection unit 200. Output signal N from speed sensor 150 and a signal QK with respect to the fuel quantity to be injected are fed to fuel-delivery control unit 236. Signal QK regarding the fuel quantity to be injected comes from a fuel-quantity calculation unit 207.

A leakage precontrol unit 240 supplies a signal QL to the selection unit. Leakage precontrol unit 240 receives signal P from the pressure sensor 140. A signal T from a temperature sensor 209 is further supplied to leakage precontrol unit 240. Temperature signal T also arrives at a start-value input 242 which supplies a signal QS to selection unit 200.

Setpoint input unit 205 and fuel-quantity calculation unit 207, for example, are contained in control unit 160. Fuel-delivery control 236 usually sends to the injectors a drive signal A which determines the fuel quantity to be injected. Setpoint input unit 205 calculates setpoint value PS as a function of various operating states such as speed N and fuel quantity to be injected QK.

Selection unit 200 acts upon both pressure-control valve 135 with a drive signal UD and controllable high-pressure pump 125 with a drive signal QM. Various sensor signals such as speed signal N from speed sensor 150 and signal QK from fuel-quantity calculation unit 207 are also supplied to selection 200.

First controller 222 determines a drive signal UR to act upon pressure-control valve 135 based on the comparison of setpoint value PS and actual value P of the pressure. Furthermore, a first precontrol value UVS1 and a second precontrol value UVS2 are determined as a function of setpoint value PS of the pressure and speed N of the internal combustion engine. In this context, further performance characteristics that are not explicitly mentioned can also be taken into consideration.

First precontrol value UVS1 of first precontrol unit 224 is used, for example, during the start for driving pressure-control valve 135. This value is selected in such a way that the pressure-control valve 135 disables the connection between the high-pressure region in accumulator 130 and the tank 100 until the pressure has exceeded a predefined threshold value. The predefined threshold value and drive value UD are a function of setpoint value PS of the pressure.

Second precontrol value UVS2 is selected in such a way that the pressure-control valve 135 remains closed during running operation. This drive value is predefinable as a function of the pressure setpoint value.

Variables UR, UVS1 and UVS2 are used for forming drive signal UD for pressure-control valve 135.

The high-pressure pump is so designed that, in response to receiving a signal QM, it delivers a specific fuel quantity from the low-pressure region into accumulator 130.

Based on the comparison between actual value P and setpoint value PS for the pressure in the accumulator, second controller 232 supplies a drive signal QR for acting upon high-pressure pump 125.

Maximum-value input unit 234 supplies value QMAX as a function of the speed. This value is selected so that the pump delivers the maximum possible quantity during normal operation. Fuel-delivery precontrol unit 236 determines a signal QVS, used as a precontrol variable, based on various performance characteristics such as injected fuel quantity QK and speed N. Leakage precontrol unit 240 specifies a value QL based on the temperature and/or actual pressure value P. In this context, the fuel temperature is taken into account. Start-value input unit 242 stipulates a quantity value QS, which is used during the start.

A value which characterizes the fuel temperature in accumulator 130 is used as temperature. Instead of or in addition to the temperature sensor for the fuel, another substitute value with respect to the temperature also may be used. For example, it is possible to use a temperature sensor that detects the cool-water temperature or the engine temperature.

Besides speed N, fuel quantity to be injected QK and/or temperature T, further performance characteristics can also be used for the input of the various values.

Variables QR, QMAX, QVS, QL and QS are used to form signal QM for driving high-pressure pump 125.

According to the present invention, different pressure-control means are used as a function of the operating state of the internal combustion engine.

In a first operating state, a first pressure-control means is used for adjusting the pressure. In the first operating state, signal UR and/or precontrol value UVS1 determines drive signal UD for acting upon pressure-control valve 135. Thus, in this first operating state, first controller 222 determines drive signal DU for pressure-control valve 135. The pressure-control valve influences the pressure in this first operating state. This means that the first pressure-control means is pressure-control valve 135 which connects the accumulator to the low-pressure region, for example, tank 100. The second pressure-control means is driven by signal QM=QMAX, such that the high-pressure pump is completely filled.

A second pressure-control means is used for adjusting the pressure in a second operating state in the second operating state, signal QR and precontrol value QVS determine drive signal QM for acting upon high-pressure pump 125. Thus, second controller 232 determines the drive signal for high-pressure pump 125 in this second operating state. The high-pressure pump influences the pressure in this second operating state. This means that the second pressure-control means is high-pressure pump 125. Pressure-control valve 135 is driven by signal UD=UVS2 such that the pressure-control valve remains reliably closed.

At small loads, low speed and/or low temperatures, the first operating state prevails. At large loads high speed and/or high temperatures, the second operating state prevails.

Very good control precision and dynamic control response of the pressure-control circuit are attained in the first state. Furthermore, in the case of low fuel temperatures, the fuel can be heated up quickly.

In the second state, the pressure generation functions with the best possible efficiency and the least fuel heating.

Figure 3:
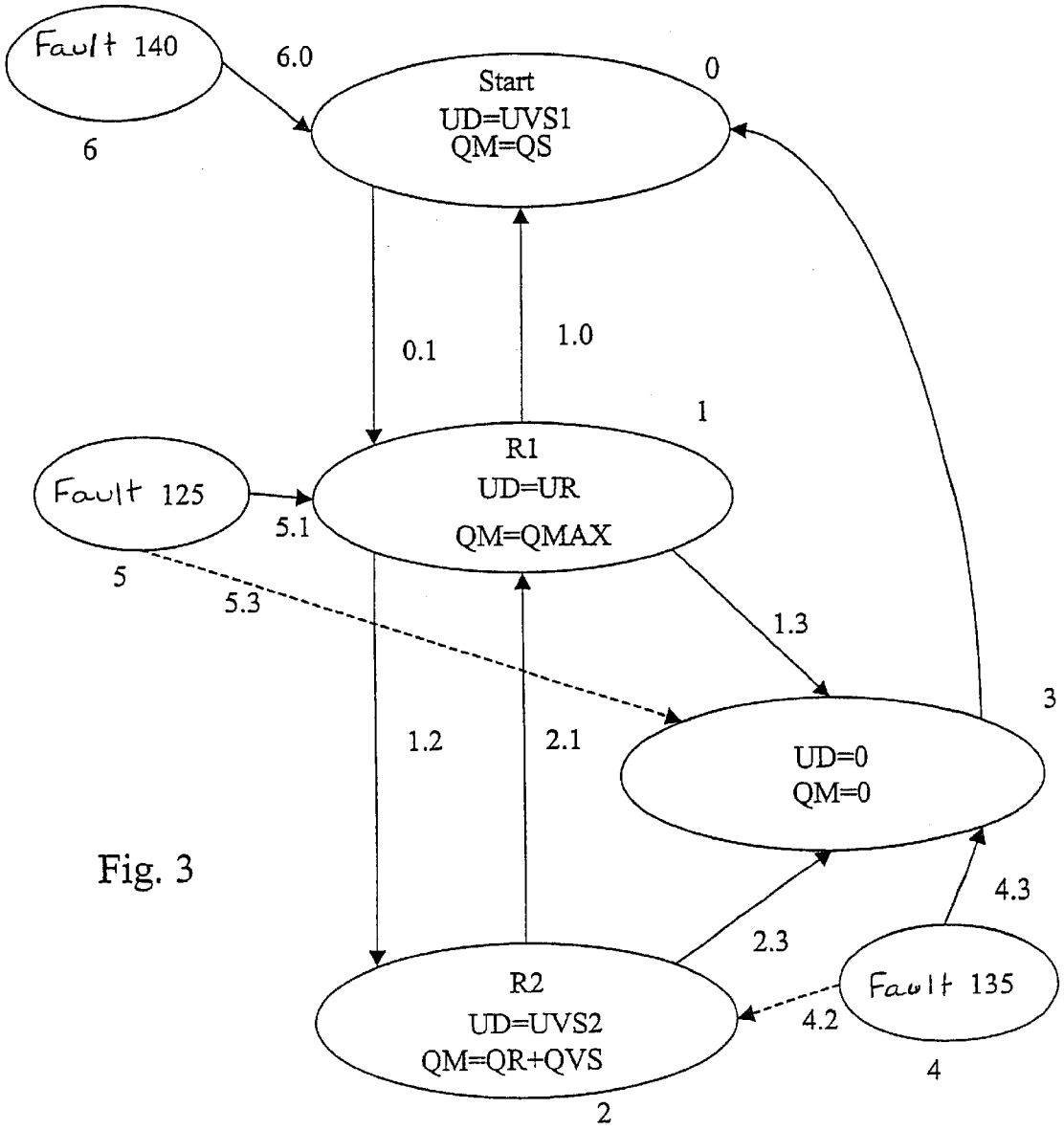
FIG. 3 shows a diagram of operating states of an internal combustion engine according to the present invention.

The various operating states of the internal combustion engine described in a states diagram in FIG. 3. The different operating states are designated in the following as states.

In FIG. 3, first state 1 and second state 2 are depicted as ellipses. The change-over from the first state into the second state in designated by an arrow marked as 1.2. Correspondingly, the change-over from the second state into the first state is shown by an arrow designated as 2.1.

Furthermore, a start is designated as state 0. The change-over from state 0 into state 1 is marked with an arrow 0.1, and the change-over from state 1 into state 0 is marked with an arrow 1.0.

In addition, a distinction is made between various fault states 4, 5 and 6. In response to a fault state 4, in which a fault has occurred in the region of pressure-control valve 135, a change-over is made into state 2, which is shown by a dotted arrow 4.2. Moreover, a change-over is made into a state 3, in which the internal combustion engine is switched off; this change-over is shown by an arrow 4.3. In response to a fault of the high-pressure pump in state 5, the system changes into state 1. This change-over is marked by an arrow 5.1. In response to a fault of pressure sensor 140 in state 6, the system changes into start state 0. This changeover is designated by arrow 6.0. One embodiment can also provide for a changeover from fault state 5 into state 3, as well. This change-over is shown by a dotted arrow 5.3.

In first state 1, first pressure-control means R1 is used for adjusting the pressure; that is to say, in state 1 the pressure is adjusted by driving pressure-control valve 135. Signal UD is equal to output signal UR of first controller 222. Output signal QM is equal to signal QMAX which corresponds to the output signal of maximum-value input unit 234. This signal QMAX is selected so that pump 125 delivers its maximum fuel quantity.

In second state 2, second pressure-control means R2 is used for adjusting the pressure. This means that high-pressure pump 125 is used for regulating pressure in the second state. Pressure-control valve 135 is closed. This is achieved in that drive signal UD for pressure-control valve 135 is equal to precontrol unit value UVS2 provided by second precontrol 226. This value is selected so that pressure-control valve 135 remains constantly closed. In this context, the drive signal is predefined as a function of the setpoint pressure and/or the actual pressure and the speed, such that it opens if a highest permissible pressure is exceeded, i.e., the pressure-control valve is used as a safety valve. Drive signal QM for the high-pressure pump corresponds to the sum of output signal QR of second controller 232 and output signal QVS of fuel-delivery precontrol unit 236.

If the control is in first state 1, i.e. pressure-control valve 135 is active and regulating the pressure, then a change-over is made into second state 2 if specific values for the speed and the fuel quantity to be injected are exceeded. In response to the change-over from first state 1 into second state 2, i.e. from change-over 1.2, the integral-action component of the second controller is initialized accordingly. This means that output signal QR is set with the output signal of leakage precontrol unit 240, i.e., in the change-over from the first state into the second state, signal QR assumes the value QL at the beginning.

Correspondingly, in the change-over from second state 2 into first state 1, the integral-action component of first controller is initialized, such that value UR corresponds to output signal UVS1 of the first precontrol unit.

During the start of the internal combustion engine in state 0, start value UVS1 acts upon pressure-control valve 135. Furthermore, high-pressure pump 125 receives a signal QM which corresponds to output signal QS of start input 242. These two signals are selected such that the maximum possible fuel quantity is delivered as a function of temperature T and/or speed N and possible further performance characteristics, and no fuel is discharged via the pressure-control valve. This permits a very rapid pressure build-up during the start.

If pressure value P and/or speed N exceeds a predefined threshold value, then change-over 0.1 is made into the first state. In so doing, the integral-action component of the first controller is initialized, such that drive signal UD for the pressure-control valve is equal to output signal UVS1 of first precontrol unit 224. If pressure P falls below the threshold value, and/or the speed is less than a start speed, then there is a change-over again into state 0.

If the internal combustion engine is to be switched off, then change-over 1.3 or 2.3 into state 3 is performed. In state 3, drive signal UD and drive signal QM are selected so that the high-pressure pump delivers no fuel and the pressure-control valve releases the connection to the tank.

In addition, various fault cases are differentiated. In a first fault case, designated as state 4, a defect is recognized in the pressure-control valve. In this case, there is a change-over into state 3 and the internal combustion engine is switched off. In one embodiment, a change-over 4.2 is effected into second state 2, in which high-pressure pump 125 takes over the regulation of pressure.

In a second fault state 5, a fault is recognized in the high-pressure pump. In, this case, change-over 5.1 into the first state is performed, in which the pressure-control valve regulates the pressure. Alternatively, provision can also be made for performing change-over 5.3 into state 3 and switching off the internal combustion engine.

If a fault is detected in one of the pressure-control means, the other pressure-control means takes over the control.

If a third fault state 6 is recognized in which a defect exists in pressure sensor 140, a change-over 6.0 is effected into state 0 that corresponds to the start state. In this case, pressure-control valve 135 with manipulated variable UD=UVS1 assumes the pressure control. The high-pressure pump is driven by signal QS.

Figure 4:
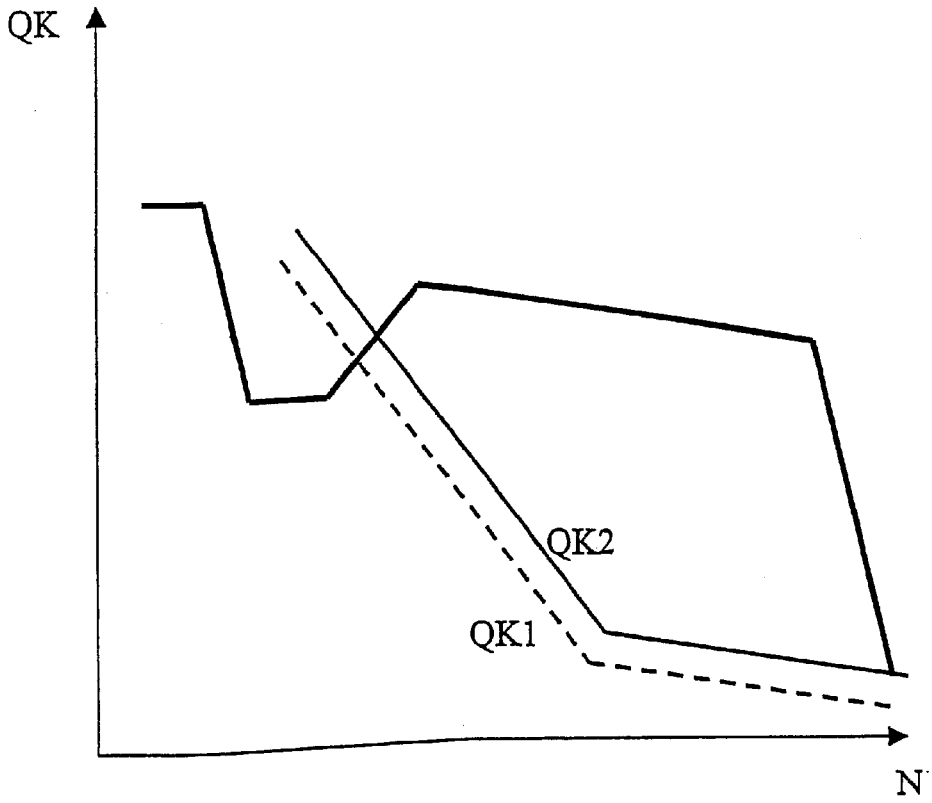
FIG. 4 shows various signals plotted over time.

In FIG. 4, injected fuel quantity QK is plotted over speed N. The highest permissible fuel quantity customary in diesel gasoline engines is plotted with a thick, solid line over the speed. A fuel quantity QK2 as a function of speed N is plotted with a thin, solid line, and a fuel quantity QK1 is plotted with a dotted line over speed N. In this context, the operating state is defined in each case by a value of fuel quantity QK and speed N. Embodiment of the present invention can also provide for using further variables to define the operating state. They are, for example, temperature and pressure values. Furthermore, in a simplified specific embodiment, provision can be made for using only the speed or the fuel quantity to define the operating state. Instead of the fuel quantity, other variables can also be used that determine the fuel quantity. Thus, the injection time, the time the injectors are driven, a load variable and/or a torque variable can also be used.

According to the present invention, given the change from an operating state from below line QK2 to an operating state above line QK2, the device goes over into state 2. Correspondingly, given the transition from an operating state above line QK1 to an operating state below line QK1, a change-over is made into state 1. That is to say, the two lines QK1 and QK2 separate the operating states in which, first of all, state 1 prevails, and secondly, state 2 prevails. To avoid unnecessary switching operations, a difference which acts as hysteresis is provided between lines QK1 and QK2. In the case of the change-over into the second state, the change-over is first effected in response to values above line QK2, and for the change-over into state 1, it is first effected below the values of line QK1.

Figure 5:
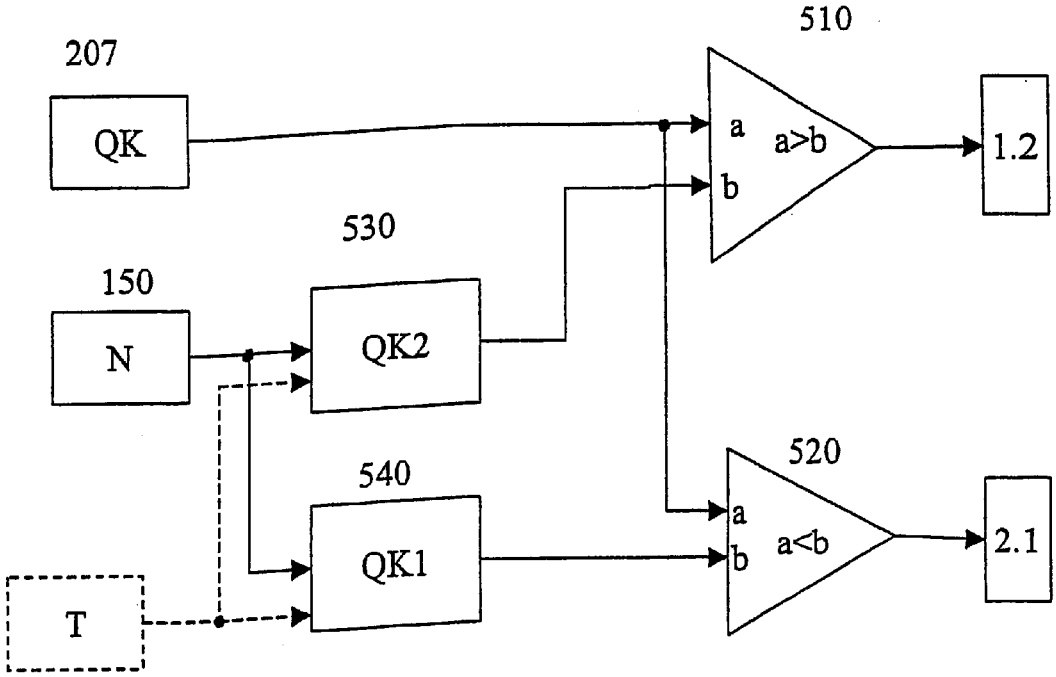
FIG. 5 shows a block diagram of selection of operating states of an internal combustion engine according to the present invention.

The change-over from state 1 into state 2 and vice-versa is shown in FIG. 5 with the aid of a block diagram. Signal QK from fuel-quantity calculation unit 207 is fed to an input a of a first comparator 510 and an input a of a second comparator 520. Output signal QK2 of a first characteristic curve 530 is applied at input b of first comparator 510. Output signal QK1 of a second characteristic curve 540 is applied at input B of second comparator 520.

Both characteristic curves 530 and 540 receive output signal N from the speed sensor. The characteristic of fuel quantity QK2 plotted in FIG. 4 is stored in first characteristic curve 530, and the characteristic of line QK1 is stored in the second characteristic curve. In this context, the characteristics shown in FIG. 4 are merely selected by way of example.

Instead of the characteristic curves, families of characteristics can also be used which take into account a temperature T, e.g., the fuel temperature, as a further variable. This is depicted with dotted lines in FIG. 5.

If first comparator 510 recognizes that the value at input a is greater than at input b, then a change-over 1.2 is performed from state 1 into state 2. If second comparator 520 recognizes that the signal at input a is smaller than at input b, then a changeover 2.1 from state 2 into state 1 is effected.

What is claimed is:

1. A method for controlling an internal combustion engine, the method comprising:

delivering fuel into an accumulator via at least one pump;

detecting a pressure in the accumulator;

distinguishing between at least one first operating state and at least one second operating state as a function of at least one of at least one speed signal and at least one load signal;

adjusting the pressure in the at least one first operating state via at least one first pressure-control device; and adjusting the pressure in the at least one second state via at least one second pressure control device.

2. The method according to claim 1, wherein:

the internal combustion engine has a common-rail system.

3. The method according to claim 1, wherein:

the at least one second operating state exists during at least one of large loads, high speeds, and high temperatures.

4. The method according to claim 1, wherein:

the one first operating state exists during at least one small loads, low speeds, and low speeds.

5. The method according to claim 1, wherein:

one of the at least one first pressure control device and the at least one second pressure control device takes over control when there is a fault in the other of the at least one first pressure control device and the at least one second pressure control device.

6. A device for controlling an internal combustion engine, the device comprising:

an accumulator;

at least one pump for delivering fuel to the accumulator;

a sensor for detecting a pressure in the accumulator;

an arrangement for distinguishing between at least one first operating state and at least one second operating state as a function of at least one of at least one speed signal and at least one load signal;

at least one first pressure-control device for adjusting the pressure in the at least one first operating state; and at least one second pressure-control device for adjusting the pressure in the at least one second operating state.

7. The device according to claim 6, wherein:

the internal combustion engine has a common-rail system.

8. The device according to claim 6, wherein:

the at least one first pressure-control device includes a valve, the valve connecting the accumulator to a low-pressure region.

9. The device according to claim 8, wherein:

the at least one second pressure-control device includes a controlled pump, the controlled pump delivering the fuel to the accumulator.

* * * * *